US010684089B2

(12) United States Patent
Keng

(10) Patent No.: US 10,684,089 B2
(45) Date of Patent: Jun. 16, 2020

(54) MAGAZINE FLOORPLATE WITH ONE OR MORE ACCESSORIES

(71) Applicant: Shane Keng, Marietta, GA (US)

(72) Inventor: Shane Keng, Marietta, GA (US)

( * ) Notice: Subject to any disclaimer, the term of this patent is extended or adjusted under 35 U.S.C. 154(b) by 13 days.

(21) Appl. No.: 16/228,480

(22) Filed: Dec. 20, 2018

(65) Prior Publication Data

US 2019/0195591 A1 Jun. 27, 2019

Related U.S. Application Data

(60) Provisional application No. 62/610,324, filed on Dec. 26, 2017, provisional application No. 62/672,298, filed on May 16, 2018, provisional application No. 62/703,257, filed on Jul. 25, 2018.

(51) Int. Cl.

| | |
|---|---|
| ***F41A 23/02*** | (2006.01) |
| ***F41A 9/70*** | (2006.01) |
| ***F41A 35/00*** | (2006.01) |
| ***F41A 9/65*** | (2006.01) |
| ***F41C 27/22*** | (2006.01) |

(52) U.S. Cl.

CPC ..... *F41A 23/02* (2013.01); *F41A 9/65* (2013.01); *F41A 9/70* (2013.01); *F41A 35/00* (2013.01); *F41C 27/22* (2013.01)

(58) Field of Classification Search

CPC .. F41A 23/02; F41A 9/65; F41A 35/00; F41A 9/70; F41C 27/22

See application file for complete search history.

(56) References Cited

U.S. PATENT DOCUMENTS

| | | | | |
|---|---|---|---|---|
| 6,698,127 | B2 * | 3/2004 | Weber | F41A 9/65 42/49.01 |
| D593,634 | S * | 6/2009 | Fitzpatrick | D22/108 |
| D642,647 | S * | 8/2011 | Fitzpatrick | D22/108 |
| 8,590,202 | B2 * | 11/2013 | Keng | F41A 9/65 42/90 |
| 9,097,480 | B2 * | 8/2015 | Keng | F41A 9/65 |
| 10,161,705 | B2 * | 12/2018 | Keng | F41A 23/04 |
| 10,184,746 | B1 * | 1/2019 | Liu | F41A 23/10 |
| 10,190,840 | B1 * | 1/2019 | Renteria | F41A 23/02 |

* cited by examiner

*Primary Examiner* — Joshua T Semick

(74) *Attorney, Agent, or Firm* — Eversheds Sutherland (US) LLP

(57) ABSTRACT

Shooting rests are disclosed herein. Example shooting rests includes a body with a fore end, an aft end, and a floor. The floor includes a top side and an opposed bottom side. A set of walls extends from the top side of the floor. The body also includes a set of legs extending from the opposed bottom side of the floor. A tension band is attached to the set of walls, and a selectively removable tool is disposed on the body.

20 Claims, 22 Drawing Sheets

MAGAZINE FLOORPLATE WITH ONE OR MORE ACCESSORIES

CROSS-REFERENCE TO RELATED APPLICATIONS

The disclosure claims priority to and the benefit of U.S. Provisional Application No. 62/610,324, filed Dec. 26, 2017, U.S. Provisional Application No. 62/672,298, filed May 16, 2018, and U.S. Provisional Application No. 62/703,257, filed Jul. 25, 2018, each of which are incorporated by reference in their entirety.

FIELD OF THE DISCLOSURE

The disclosure relates to shooting rest attachments for firearms.

BACKGROUND

It is an advantage to use a stabilizing support when shooting, particularly if the target is far away. Movement while aiming can cause significant shifts in the point of impact downrange, so it is desirable to stabilize the firearm as much as possible when shooting. Conventional shooting rests for firearms in the form of bipods or monopods are known in the prior art. For example, U.S. Pat. No. 7,669,357 to Moody et al., U.S. Pat. No. 7,478,496 to Bender, U.S. Pat. No. 7,197,844 to Benson, U.S. Pat. No. 7,124,528 to Long, U.S. Pat. No. 5,377,437 to Underwood and U.S. Pat. No. 4,393,614 to Pickett are all illustrative of the prior art.

While these devices accomplish the task of stabilizing a firearm for improved accuracy, they add a significant amount of additional weight and bulk in order to provide the desired function. Likewise, said devices require some form of manipulation by the user prior to being used. Furthermore, due to the complexity of the parts or materials used, the cost of manufacturing can be quite high. Accordingly, there exists a need in the art for a low cost and reliable shooting rest.

Firearm accessories generally include modifications for different parts such as the barrel, stock, slide, or sight. The accessories will modify the accuracy of the firearm, improve the weight of the firearm, or allow the firearm to be easier to take apart. One problem with firearms is a lack of storage. Creating convenient and lightweight storage space for tools on a firearm is desirable because having quick access to firearm tools is important if the firearm jams or malfunctions in some other way. Accordingly, there exists a need in the art for a lightweight and convenient storage space accessory for a firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

According to an embodiment, an aspect of the disclosure is to provide a stable shooting rest device at the base of a magazine fed firearm. The shooting rest improves upon the prior art by being significantly smaller, lighter, and cheaper to manufacture. Also, the shooting rest is always in the deployed position and requires no additional manipulation prior to use.

Figure 1:
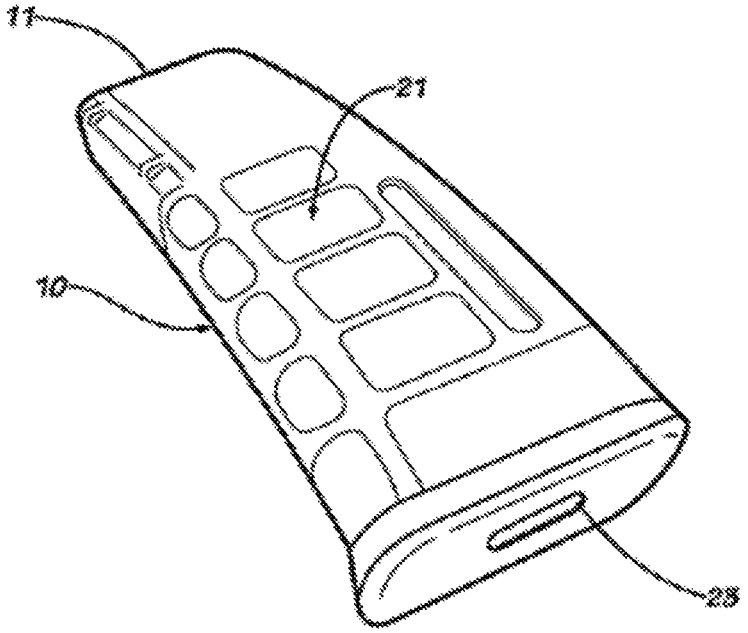
FIG. 1 depicts a perspective view of a box magazine for the M-16 rifle.
Figure 2:
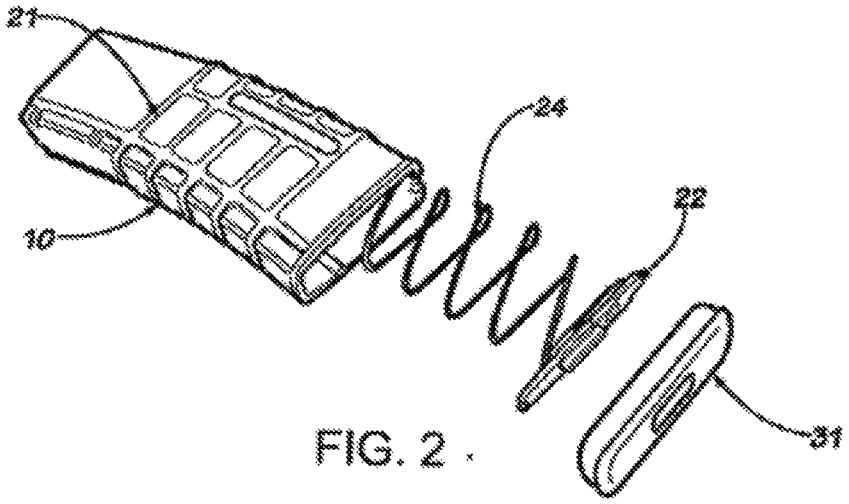
FIG. 2 depicts an exploded view of the magazine in FIG. 1.
Figure 3A:
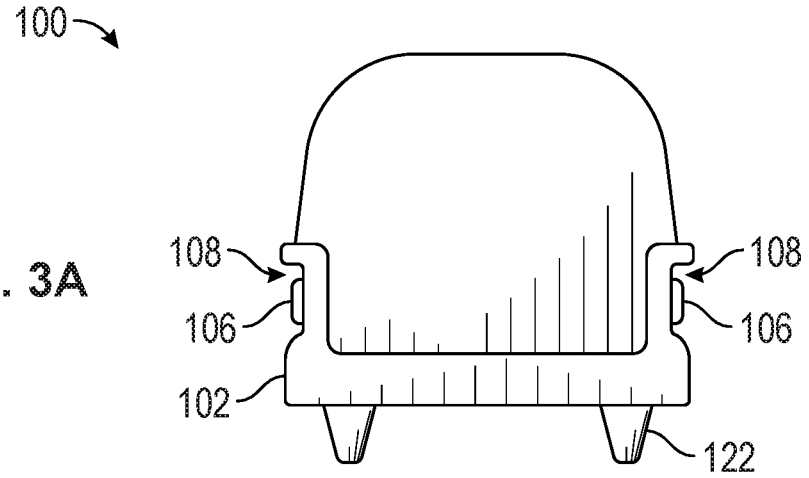
FIG. 3A depicts a rear view of a shooting rest in accordance with one or more embodiments of the disclosure.
Figure 3B:
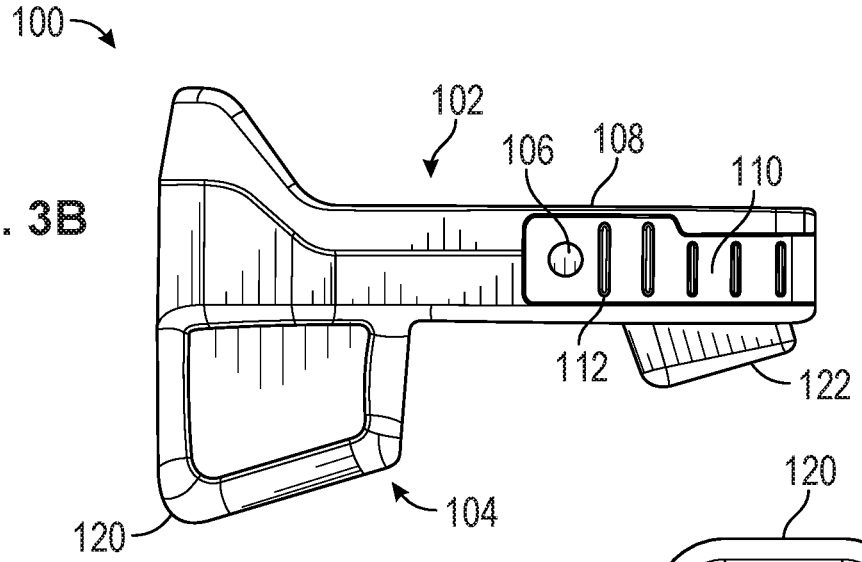
FIG. 3B depicts a side view of the shooting rest in accordance with one or more embodiments of the disclosure.
Figure 3C:
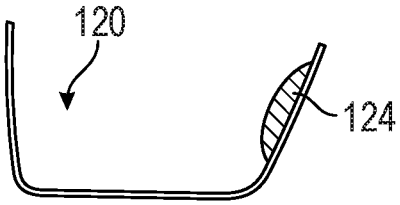
FIG. 3C depicts a magnified view of a cutout portion of the shooting rest in accordance with one or more embodiments of the disclosure.
Figure 3D:
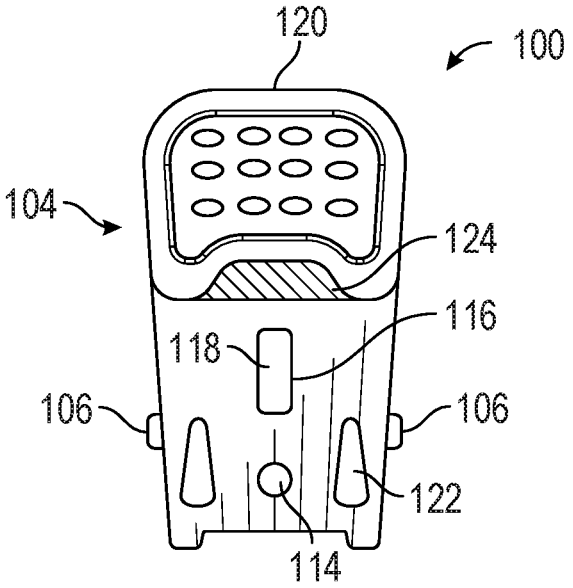
FIG. 3D depicts a bottom view of the shooting rest in accordance with one or more embodiments of the disclosure.

FIG. 1 depicts a box fed magazine 10. The box fed magazine 10 is a device that has been widely used to feed ammunition into firearms. The basic structure of the M16/AR box magazine 10 is depicted in FIG. 1. The outer case of the magazine 21 is shaped to hold ammunition in a vertically stacked arrangement. The magazine includes a feed side 11, which dispenses ammunition into the feed mechanism of the firearm, and an end or floor side, which is covered by the floor plate 23. FIG. 2 is an exploded view of the box magazine referenced in FIG. 1 and depicts a magazine spring 24 and a magazine spring guide 22 that seats into a cutout 31 on the floor plate 23. Example box magazines may include the MagPul PMAG and/or the USGI 30-rd. One of ordinary skill in the art, however, will appreciate that the shooting rest discussed herein may be attached to the bottom portion of any box magazine known in the art by any means.

FIGS. 3A-3D depicts one example of a shooting rest 100 disclosed herein. The shooting rest 100 may be configured to be coupled to a bottom portion of a firearm magazine. In some instances, the shooting rest 100 may include a magazine floor coupling 102 configured to couple to a bottom portion of the firearm magazine. The shooting rest 100 also may include a lower extension 104 extending downward from the magazine floor coupling 102. In this manner, the shooting rest 100 may be similar to the shooting rests disclosed in U.S. Pat. No. 9,097,480, which is herein incorporated by reference in its entirety. The shooting rest 100 may be any size, shape, or configuration.

The shooting rest 100 may include an attachment point 106 on each side thereof. In some instances, the attachment points 106 may be studs or other protrusions. The attachment points 106 may be any suitable size, shape, or configuration. The attachment points 106 may be disposed within respective side channels 108 formed within the outer sidewalls of the magazine floor coupling 102. In some instances, the side channels 108 may comprise relief channels cut into the back half of the magazine floor coupling 102. The side channels 108 may be any suitable size, shape, or configuration. In some instances, the attachment points 106 may be located about an end of each of the side channels 108.

A tension band 110 may be connected to the attachment points 106. In this manner, the tension band may be disposed within the side channels 108. In some instances, the tension band 110 may comprise a flat elastic band. The tension band 110 may be textured to enhance gripability and provide extra protection against magazine breakage. For example, the tension band 110 may include a number of ribs 112 or the like. The tension band 110 may extend from one attachment point 106 to the other around the backside of the shooting rest 100. The tension band 100 may be any suitable size, shape, or configuration.

The shooting rest 100 may include a drain hole 114. In some instances, the drain hole 114 may be located behind the hole 116 configured to mate with the magazine spring plunger 118. The drain hole 114 may enable water (or other liquids) to flow out of the magazine floor coupling 102. The drain hole 114 may be any suitable size, shape, or configuration.

The lower extension 104 may include a front extension 120 and a rear extension 122. A rear side of the front extension 120 may include a cutout portion 124. In some instances, the cutout portion 124 may comprise a scallop cut or the like. The cutout portion 124 may act as an index point for magazine gripping. The cutout portion 124 may be textured.

Figure 4:
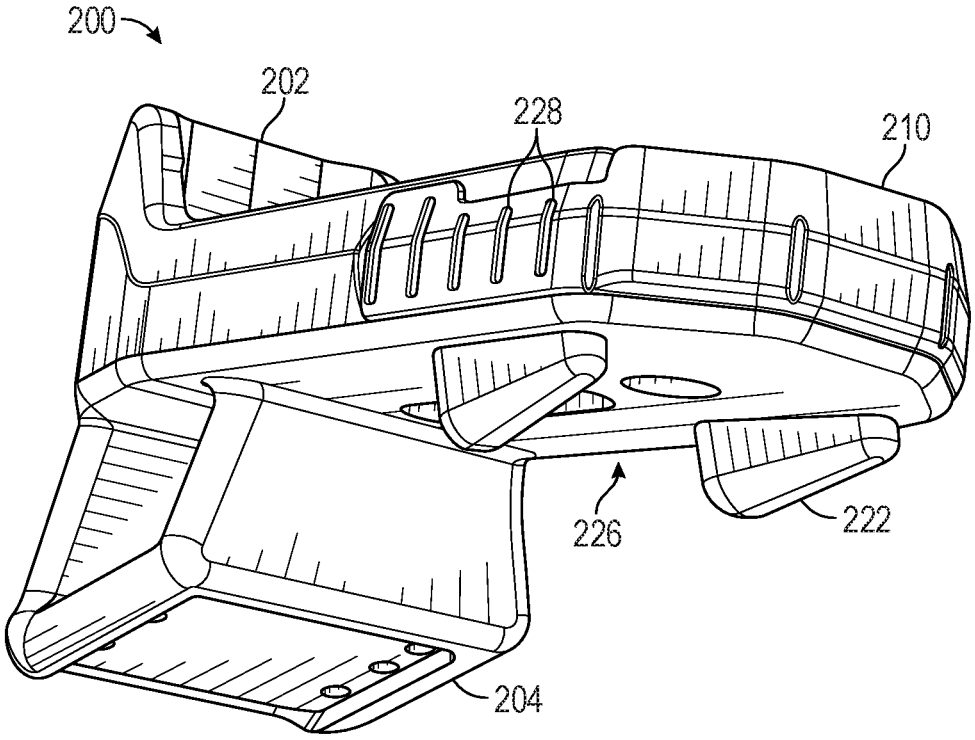
FIG. 4 depicts a perspective view of a shooting rest in accordance with one or more embodiments of the disclosure, wherein an elastic band is engaged with the magazine floorplate.
Figure 5:
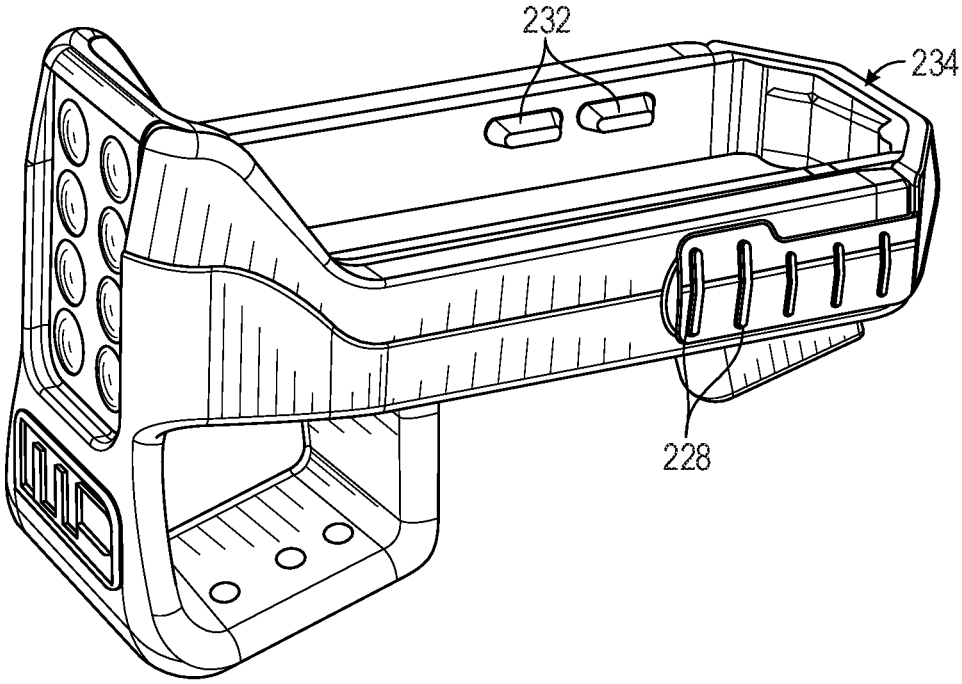
FIG. 5 depicts a front perspective view of a magazine floorplate in accordance with one or more embodiments of the disclosure, wherein the elastic band is engaged with the magazine floorplate.

In some embodiments, as seen in FIG. 4, a shooting rest 200 is shown. The shooting rest 200 includes a magazine floor coupling 202 with a selectively attachable elastic band 210. The shooting rest 200 may be configured to be coupled to a bottom portion of a firearm magazine. In some instances, the shooting rest 200 may be configured to couple to another firearm component, such as a forward grip or a magazine. The magazine floor coupling 202 may include a lower extension 204. In some instances, as shown in FIGS. 4 and 5, the lower extension 204 is a c-shaped wall extending from the floor 226 of the magazine floor coupling 202. The lower extension 204 may be another shape, such as U-shaped, T-shaped, or some other similar shape. Additionally, the lower extension 204 may be hollow or solid projecting from the floor 226. The lower extension 204 may provide stability when firing a firearm attached to the shooting rest 200 as the lower extension 204 is set upon a solid surface. For example, the magazine floor coupling 202 and the lower extension 204 may be a rigid material to firmly plant the firearm on a solid surface. The magazine floor coupling 202 may include a rear extension 222 protruding from the floor 226 of the magazine floor coupling 202. In some instances, as in FIGS. 4 and 8, the rear extension 222 comprises two legs protruding from the magazine floor coupling. The rear extension 222 may be configured to help further stabilize a firearm on a solid surface when both the rear extension 222 and the lower extension 204 are set on a solid surface.

Figure 7:
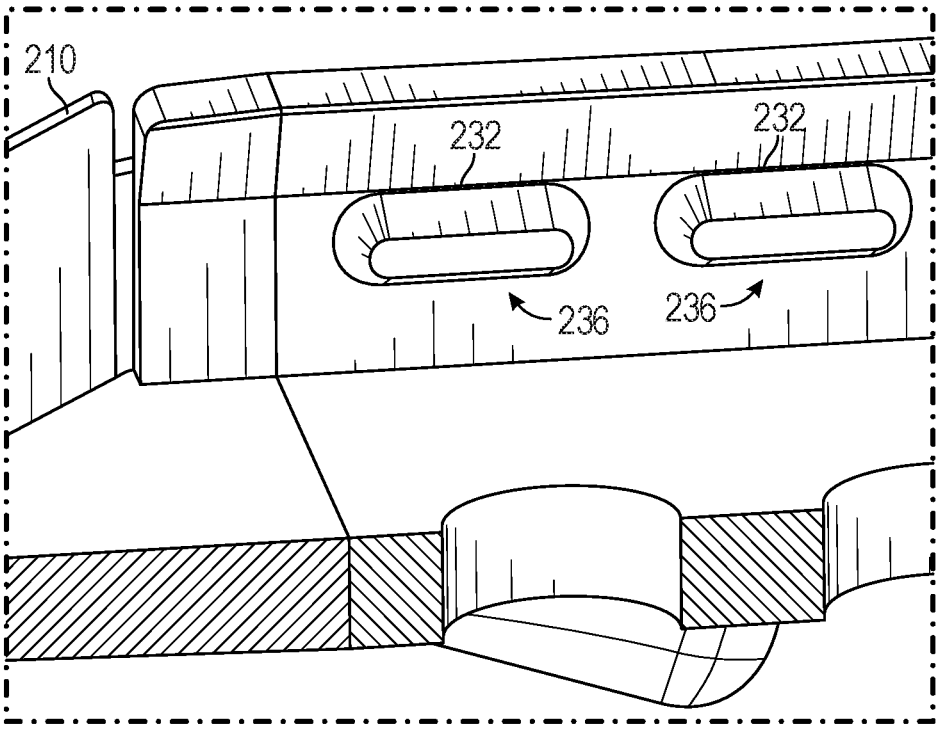
FIG. 7 depicts a cross-sectional interior perspective view of a side channel of the magazine floorplate in accordance with one or more embodiments of the disclosure.

In some embodiments, as seen in FIGS. 4 and 5, the magazine floor coupling 202 includes a selectively attachable elastic band 210. The selectively attachable elastic band 210 may be configured to store a tool between the selectively attachable elastic band 210 and the magazine floor coupling 202. For example, the selectively attachable band 210 may have a tool channel configured to leave room for storage between the magazine floor coupling 202 and the selectively attachable band 210. The selectively attachable elastic band 210 may be rigid or flexible. In some embodiments, the selectively attachable elastic band 210 may have a plurality of ribs 228 that are configured to provide grip to the selectively attachable elastic band 210. As seen in FIG. 7, the selectively attachable band 210 includes a plurality of elongated pegs 232. The plurality of elongated pegs 232 may be configured to selectively attach to a series of wall apertures 236 within the tool channel, as seen in FIG. 7, of the magazine floor coupling 202.

Figure 6:
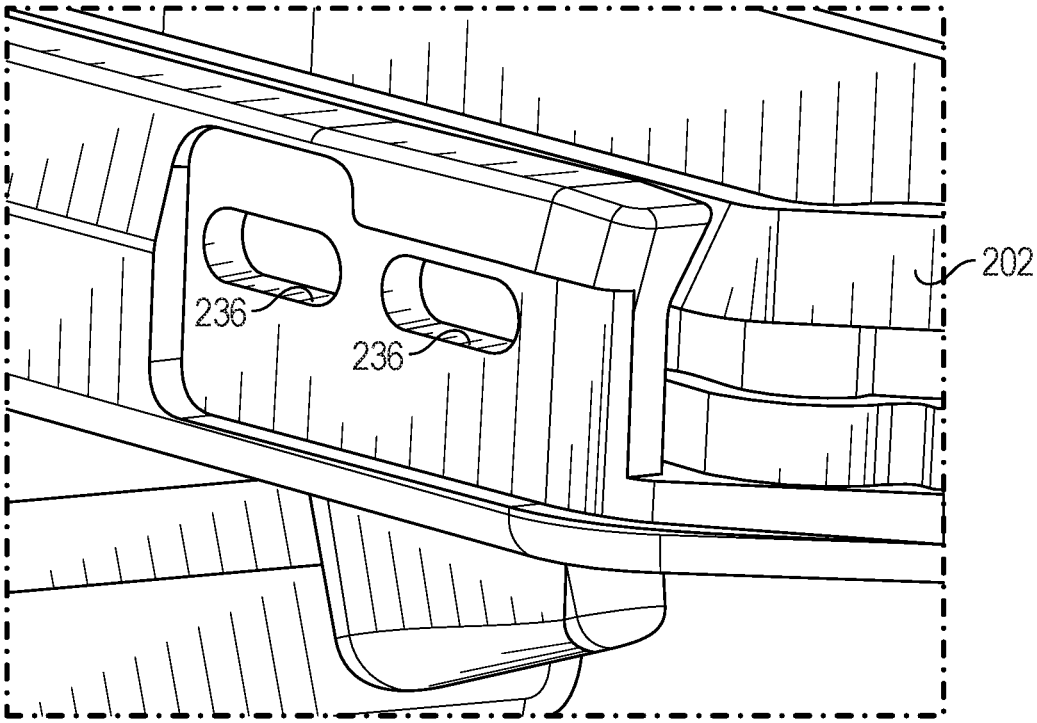
FIG. 6 depicts a perspective view of a side channel of the magazine floorplate in accordance with one or more embodiments of the disclosure.

In some embodiments, as seen in FIG. 6, the magazine floor coupling 202 includes a tool channel. The tool channel may be configured to store a plurality of tools (not shown) within the tool channel when the selectively attachable elastic band 210 is attached to a series of apertures 236. As shown in FIG. 7, the selectively attachable elastic band 210 elongated pegs 232 may slide through the apertures 236 and hold into place by friction. In other embodiments, the elongated pegs 232 may be configured to snap into the plurality of apertures 236 or may be configured to fixate by another method.

Figure 8:
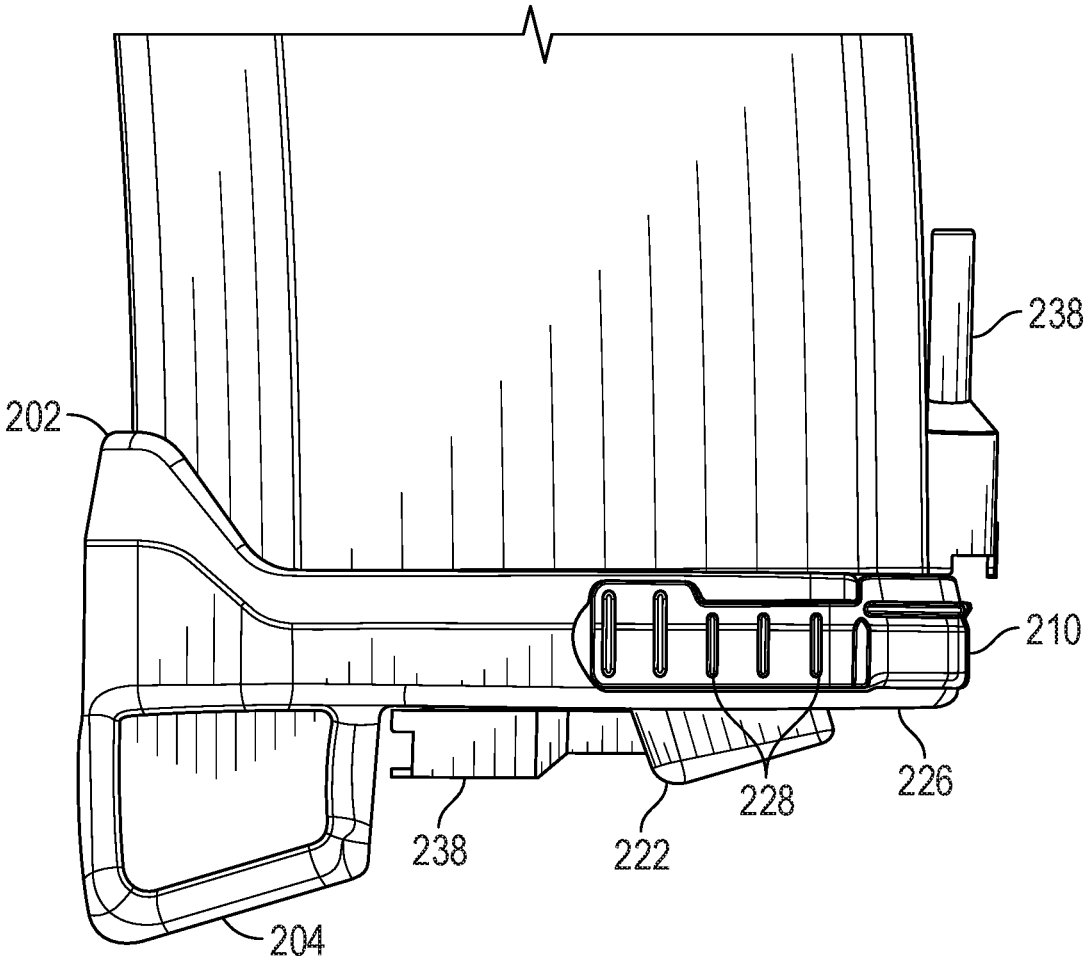
FIG. 8 depicts a side view of the magazine floorplate and a removable tool coupled to a firearm magazine in accordance with one or more embodiments of the disclosure.
Figure 9:
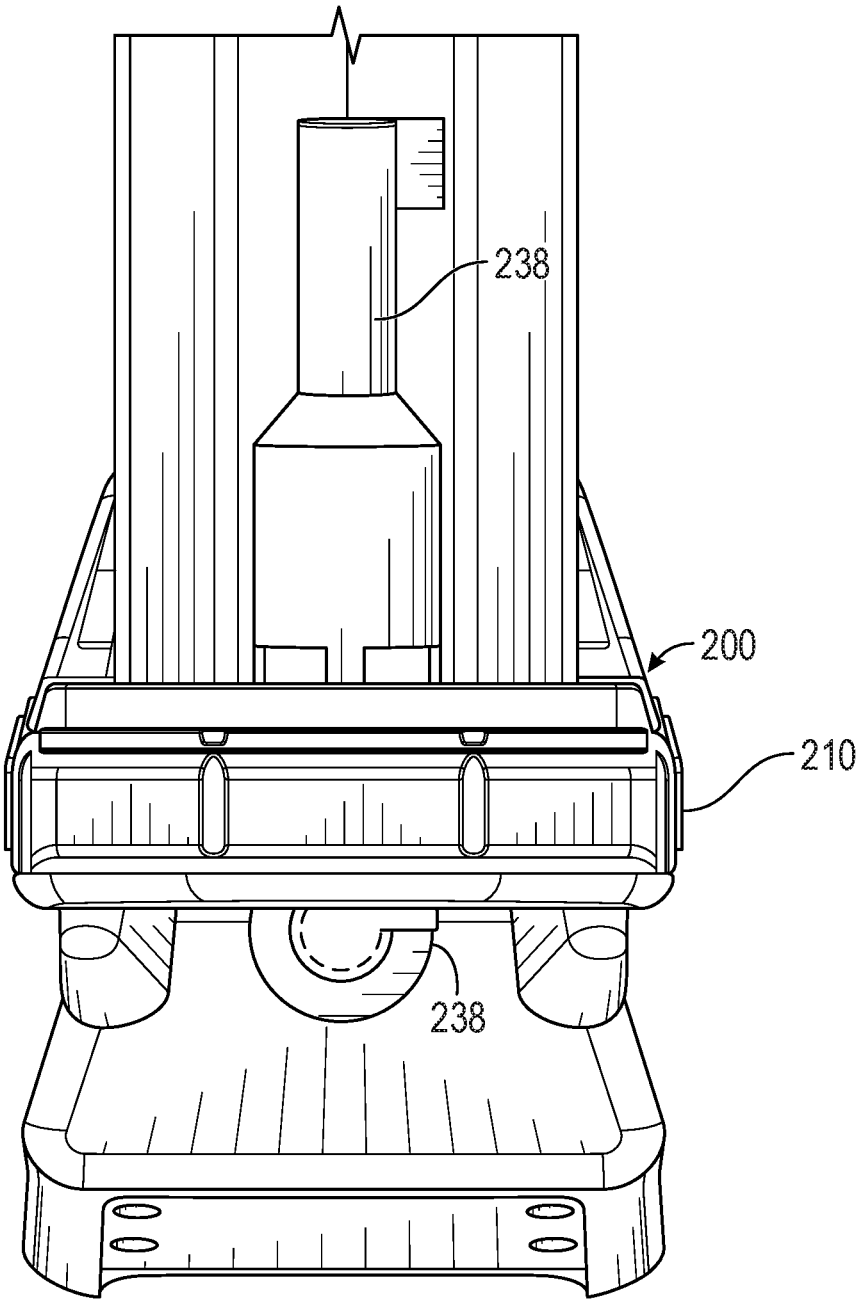
FIG. 9 depicts a rear view of the shooting rest coupled to a removable tool in accordance with one or more embodiments of the disclosure.
Figure 10:
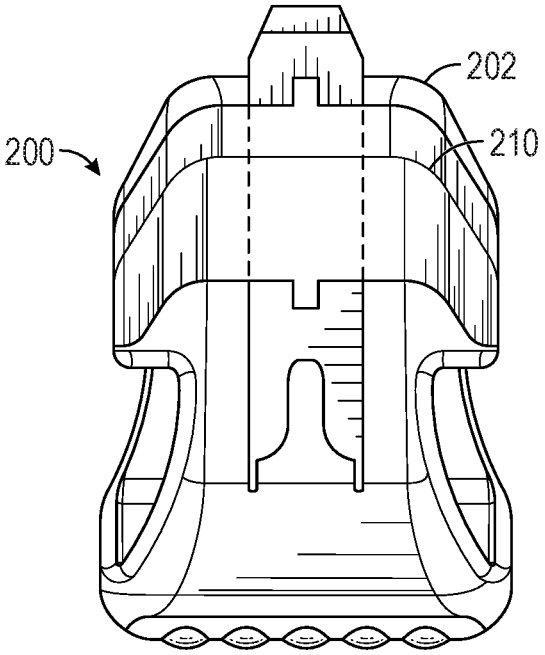
FIG. 10 depicts a front view of the shooting rest coupled to a removable elastic band in accordance with one or more embodiments of the disclosure.
Figure 11:
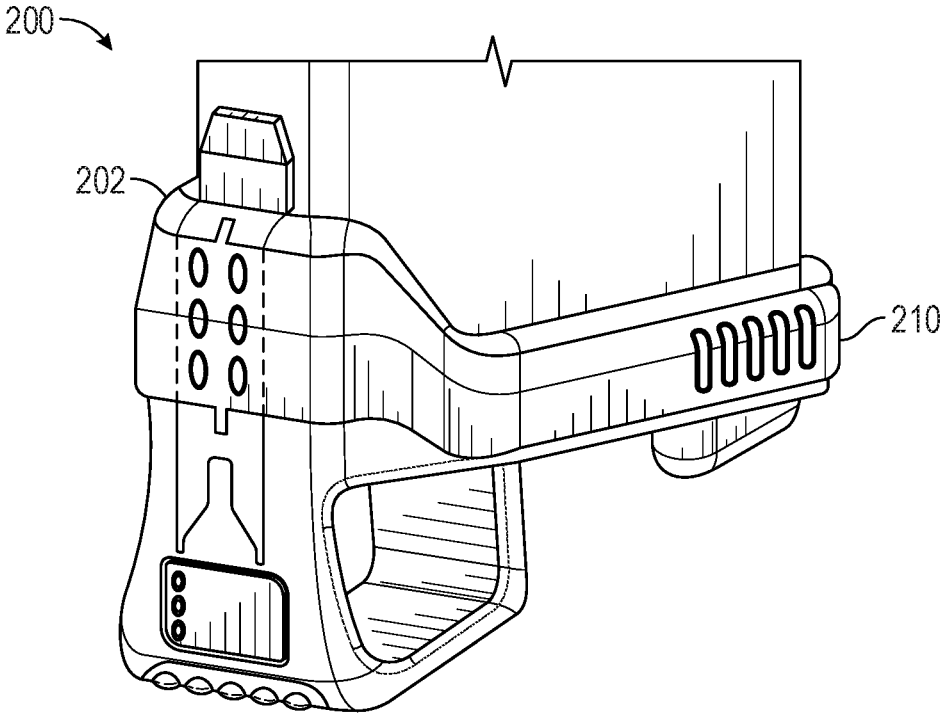
FIG. 11 depicts a front perspective view of the shooting rest coupled to the removable elastic band and a firearm magazine in accordance with one or more embodiments of the disclosure.
Figure 12:
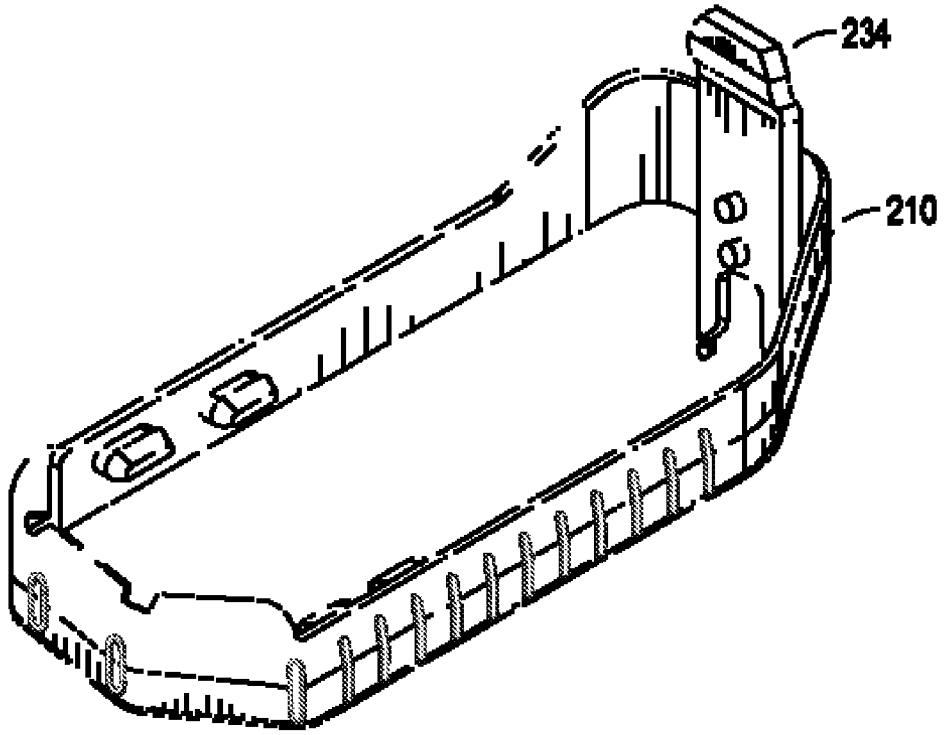
FIG. 12 depicts a top perspective view of a removable elastic band in accordance with one or more embodiments of the disclosure.

In some embodiments, as seen in FIGS. 8-9, a shooting rest 200 is shown with a removable tool 238 held in place by the attachable elastic band 210. The removable tool 238 may be stored within the attachable elastic band 210 extending away from the shooting rest 200. For example, the removable tool 238 may have a protrusion (not shown) extending from the body of the removable tool where the protrusion is configured to slide within the attachable elastic band 210. The removable tool 238 may also be stored under the floor 226. For example, the removable tool 238 may attach to the floor by sliding within a channel, attach by a fastener, or snap into place by a series of male and female attachment mechanisms. The removable tool 238 may be a flat blade screwdriver on a first end of the removable tool 238 and a semi-circular front sight post adjustment tool. In some embodiments, the semi-circular front sign post adjustment tool binds the tooling to the elastic band 210.

The shooting rest 200, as seen in FIG. 8, includes a magazine floor coupling 202 with a selectively attachable elastic band 210. The shooting rest 200 may be configured to be coupled to a bottom portion of a firearm magazine. In some instances, the shooting rest 200 may be configured to couple to another firearm component, such as a forward grip or a magazine. The magazine floor coupling 202 may include a lower extension 204. In some instances, as shown in FIGS. 4 and 5, the lower extension 204 is a c-shaped wall extending from the floor 226 of the magazine floor coupling 202. The lower extension 204 may be another shape, such as U-shaped, T-shaped, or some other similar shape. Additionally, the lower extension 204 may be hollow or solid projecting from the floor 226. The lower extension 204 may provide stability when firing a firearm attached to the shooting rest 200 as the lower extension 204 is set upon a solid surface. For example, the magazine floor coupling 202 and the lower extension 204 may be a rigid material to firmly plant the firearm on a solid surface. The magazine floor coupling 202 may include a rear extension 222 protruding from the floor 226 of the magazine floor coupling 202. In some instances, as in FIG. 8, the rear extension 222 comprises two legs protruding from the magazine floor coupling 202. The rear extension 222 may be configured to help further stabilize a firearm on a solid surface when both the rear extension 222 and the lower extension 204 are set on a solid surface.

Figure 13:
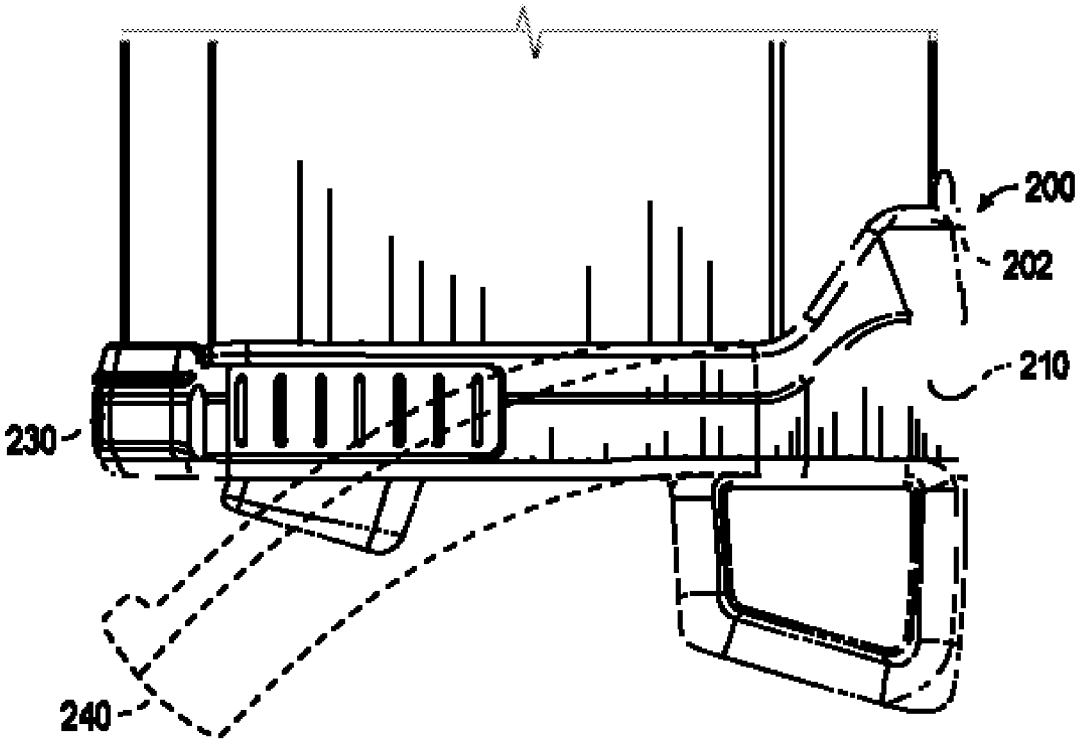
FIG. 13 depicts a side view of the method of removing the removable elastic band in accordance with one or more embodiments of the disclosure.

In some embodiments, as seen in FIGS. 10-13, a shooting rest 200 includes an elastic band 210 that is configured to swing on and off the shooting rest 200 coupled to a firearm magazine. In some instances, the magazine floor coupling 202 with the elastic band 210 may be configured to store tools behind the elastic band 210. The tools may be stored on the front, rear, or sides of the elastic band 210 of the shooting rest 200 behind the elastic band 210. As seen in FIG. 13, the elastic band 210 can move from a first position 230 to a second position 240. One benefit to the elastic band having the ability to move from a first position 230 to a second position 240 is the elastic band 210 is less likely to be misplaced since the elastic band 210 is still attached to the shooting rest 200. The elastic band 210 may have a plurality of other methods of storing a tool or methods for removing the elastic band 210 from the shooting rest 200. For example, the elastic band 210 may require a tool to be removed, sufficient force to move in an operable direction, or not be removable at all.

Figure 14:
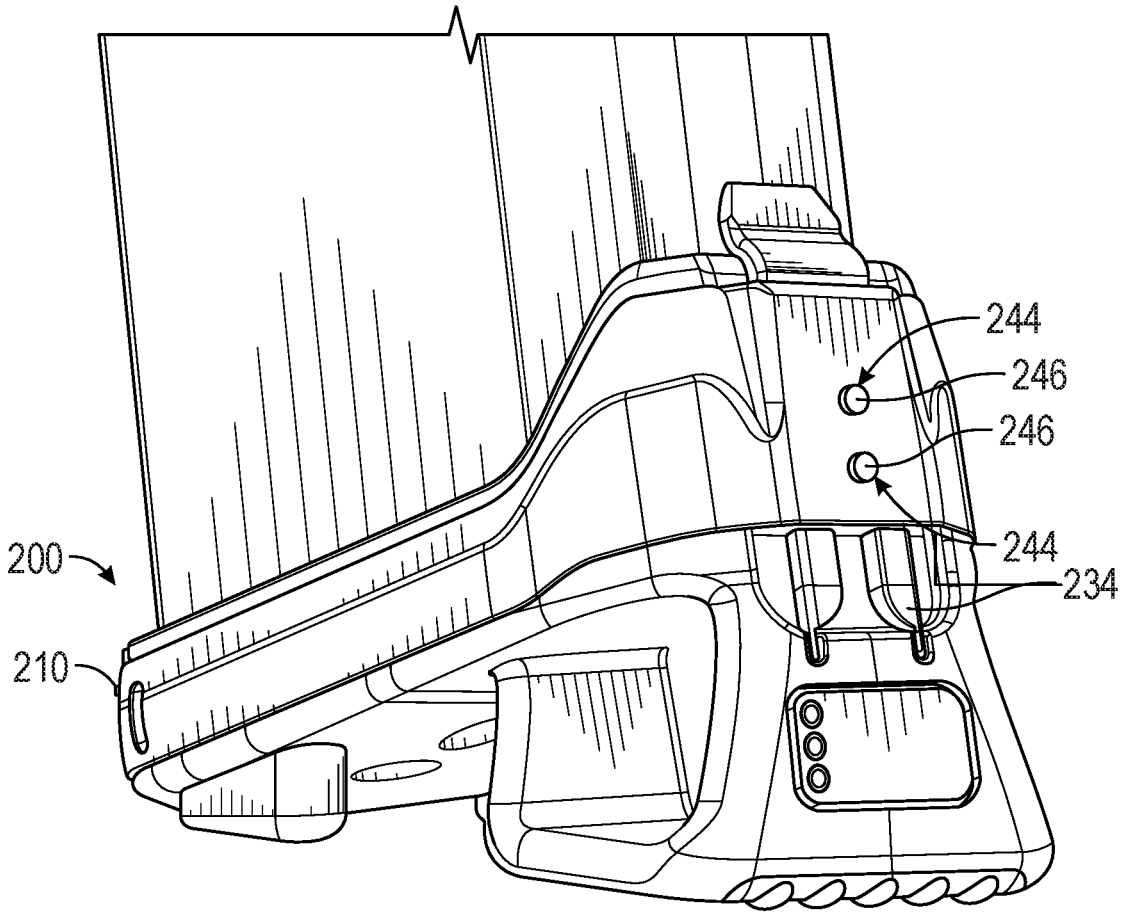
FIG. 14 depicts a front perspective view of the shooting rest coupled to the removable elastic band and the firearm magazine in accordance with one or more embodiments of the disclosure.
Figure 15:
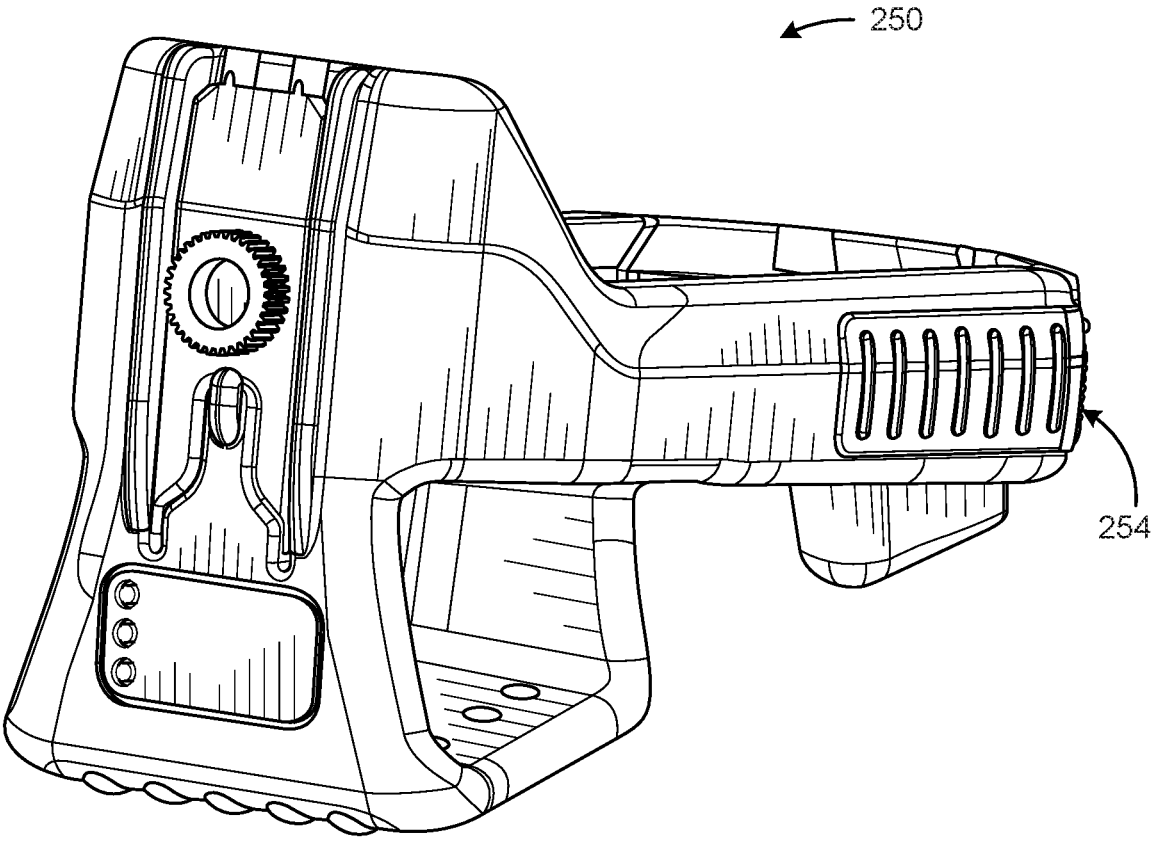
FIG. 15 depicts a front perspective view of the shooting rest in accordance with one or more embodiments of the disclosure.
Figure 16:
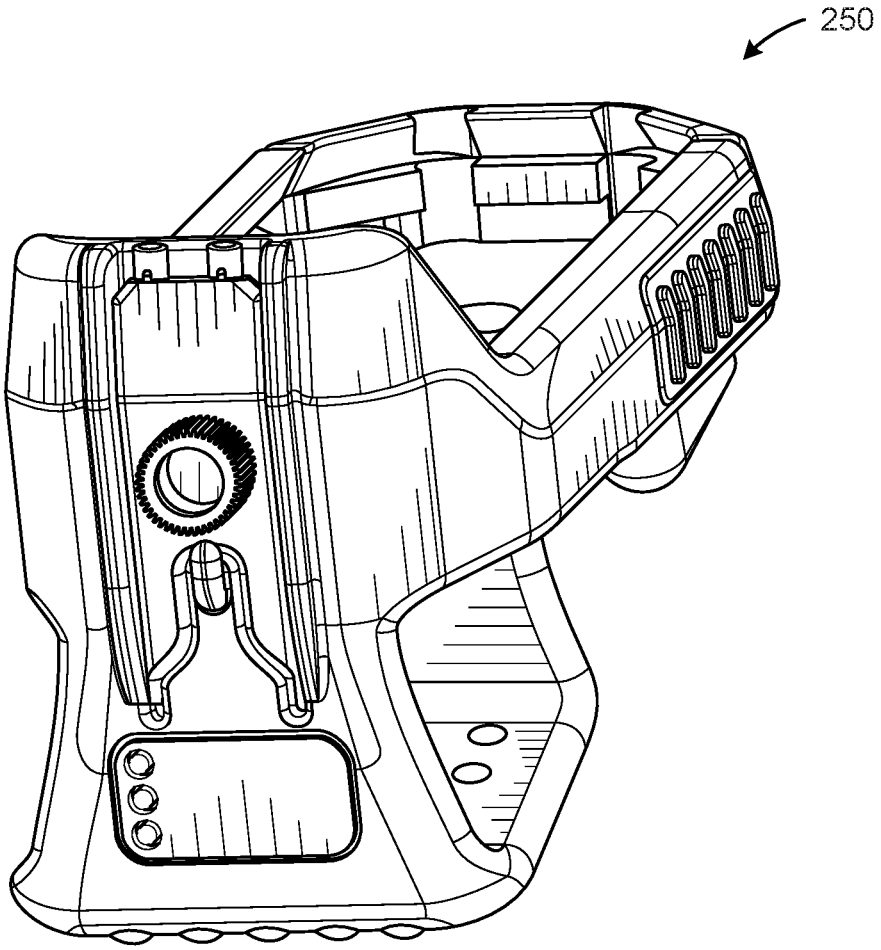
FIG. 16 depicts a front perspective view of the shooting rest in accordance with one or more embodiments of the disclosure.
Figure 17:
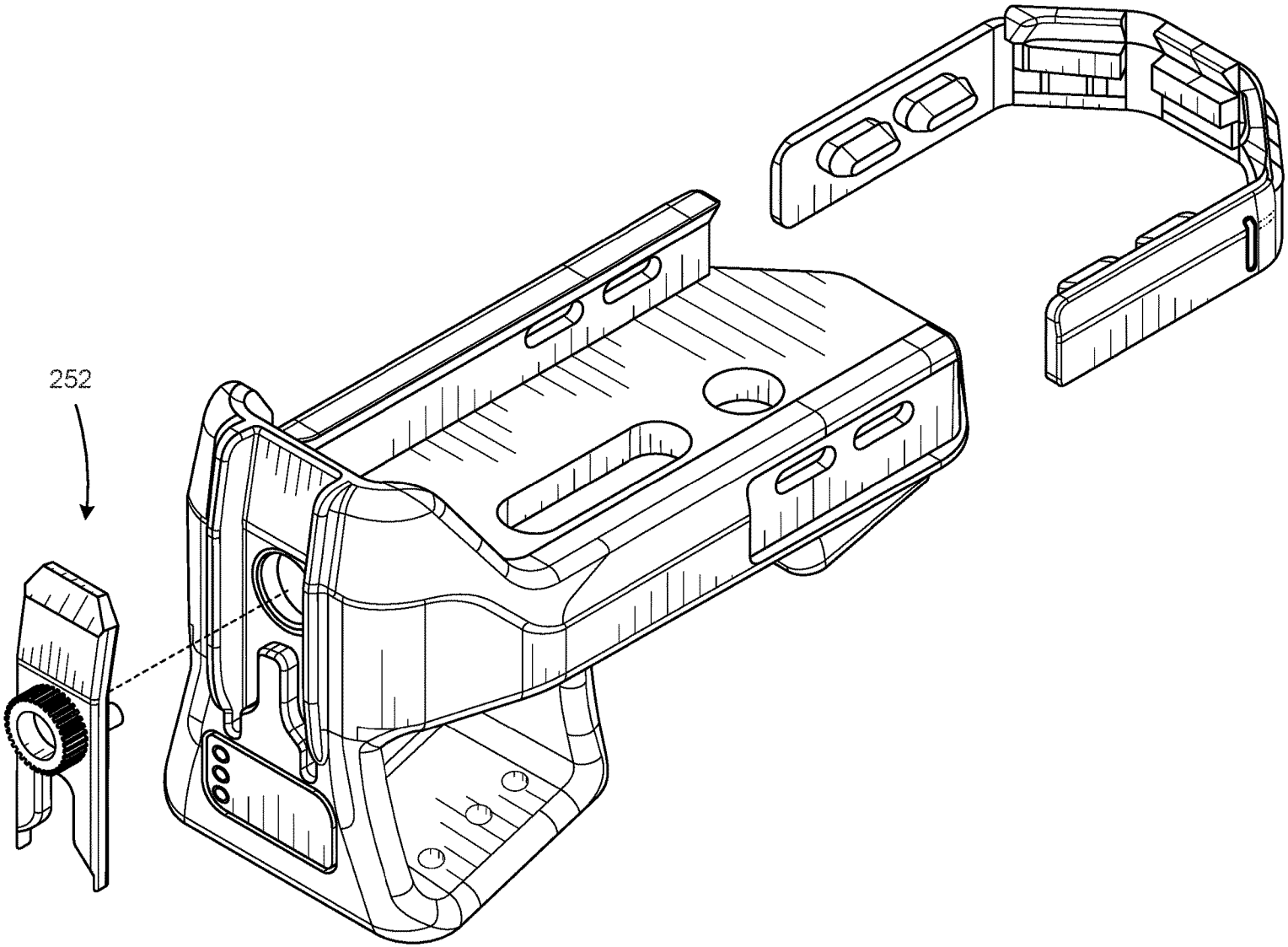
FIG. 17 depicts an exploded plan view of the shooting rest in accordance with one or more embodiments of the disclosure.
Figure 18:
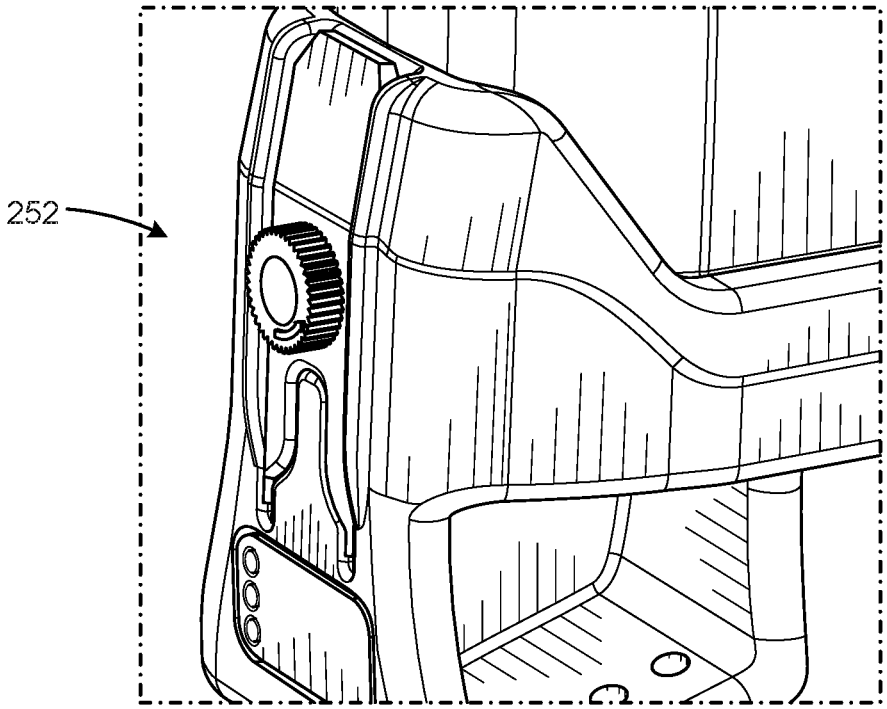
FIG. 18 depicts a perspective view of a removable tool coupled to the shooting rest in accordance with one or more embodiments of the disclosure.
Figure 19:
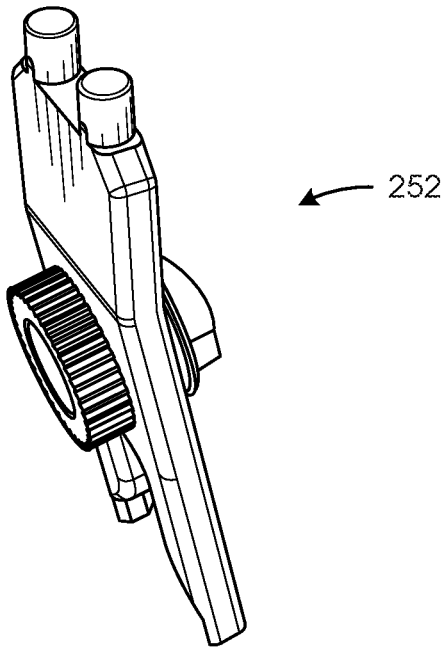
FIG. 19 depicts a perspective view of the removable tool in accordance with one or more embodiments of the disclosure.
Figure 20:
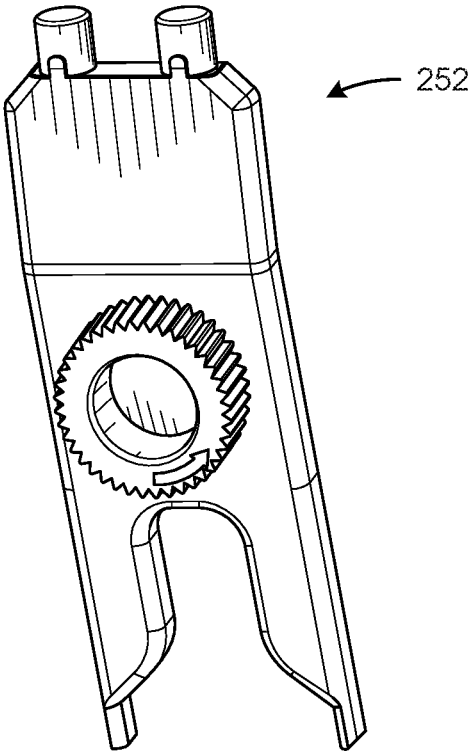
FIG. 20 depicts a front view of a removable tool in accordance with one or more embodiments of the disclosure.
Figure 21:
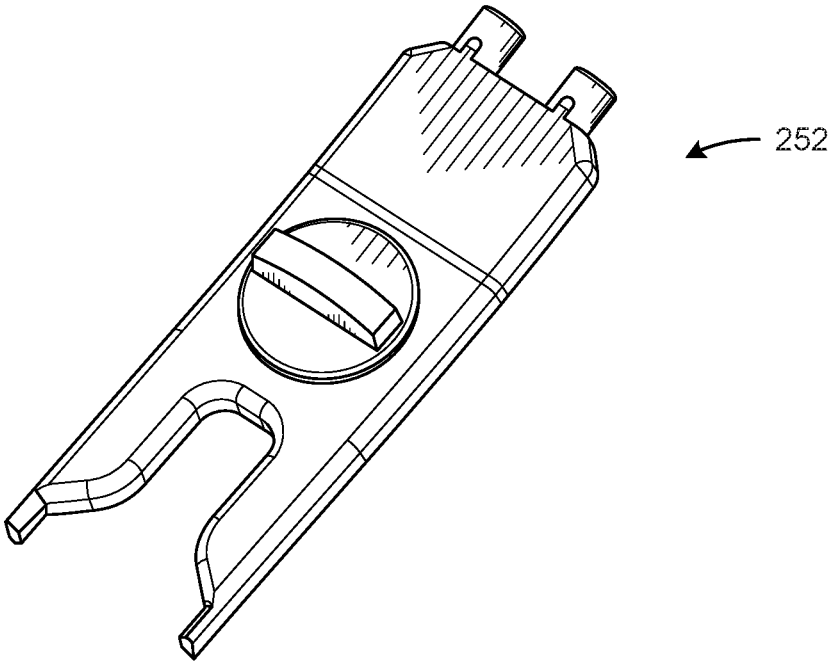
FIG. 21 depicts a rear view of a removable tool in accordance with one or more embodiments of the disclosure.

In some embodiments, as in FIGS. 13-14, the elastic band 210 wraps the entire length of the shooting rest 200. The elastic band 210 may be configured to hold a one-piece nested tool 234 behind the elastic band 210. In some instances, the one piece nested tool 234 may be a wrench, screwdriver, bits, or some other tool purposed for a firearm. The nested tool 234 may be stored within the elastic band 210. In other instances, the nested tool 234 may include a plurality of protrusions 246 that secure the nested tool 234 into place by penetrating a set of apertures 244 within the elastic band 210.

In some embodiments, as shown in FIGS. 15-21, the shooting rest 250 includes an embedded removable tool 252 and an elastic band 254. In some instances, the removable tool 252 includes one or more tools extending from one or more ends of the removable tool 252.

Figure 22:
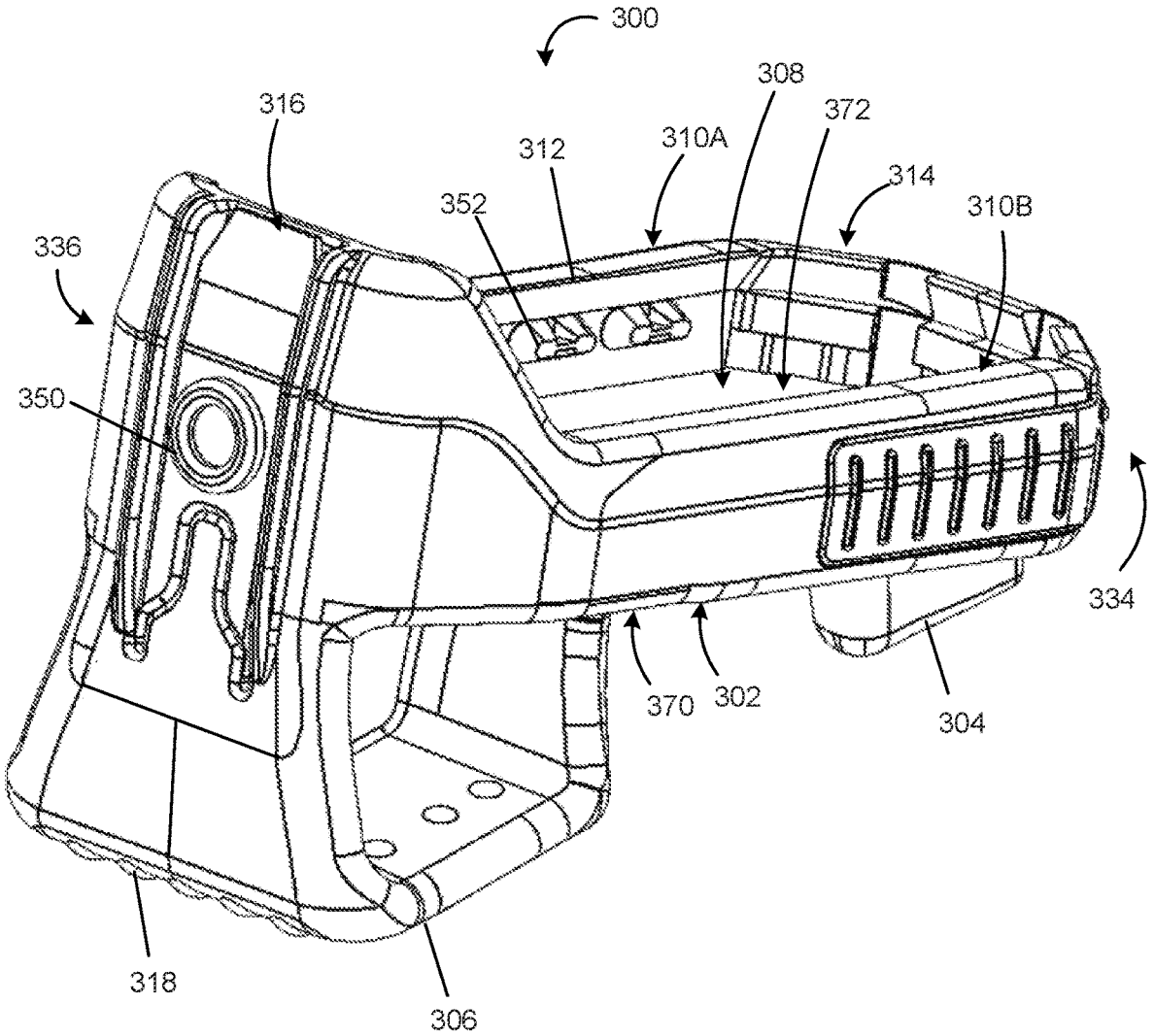
FIG. 22 depicts a front perspective view of a shooting rest in accordance with one or more embodiments of the disclosure.
Figure 23:
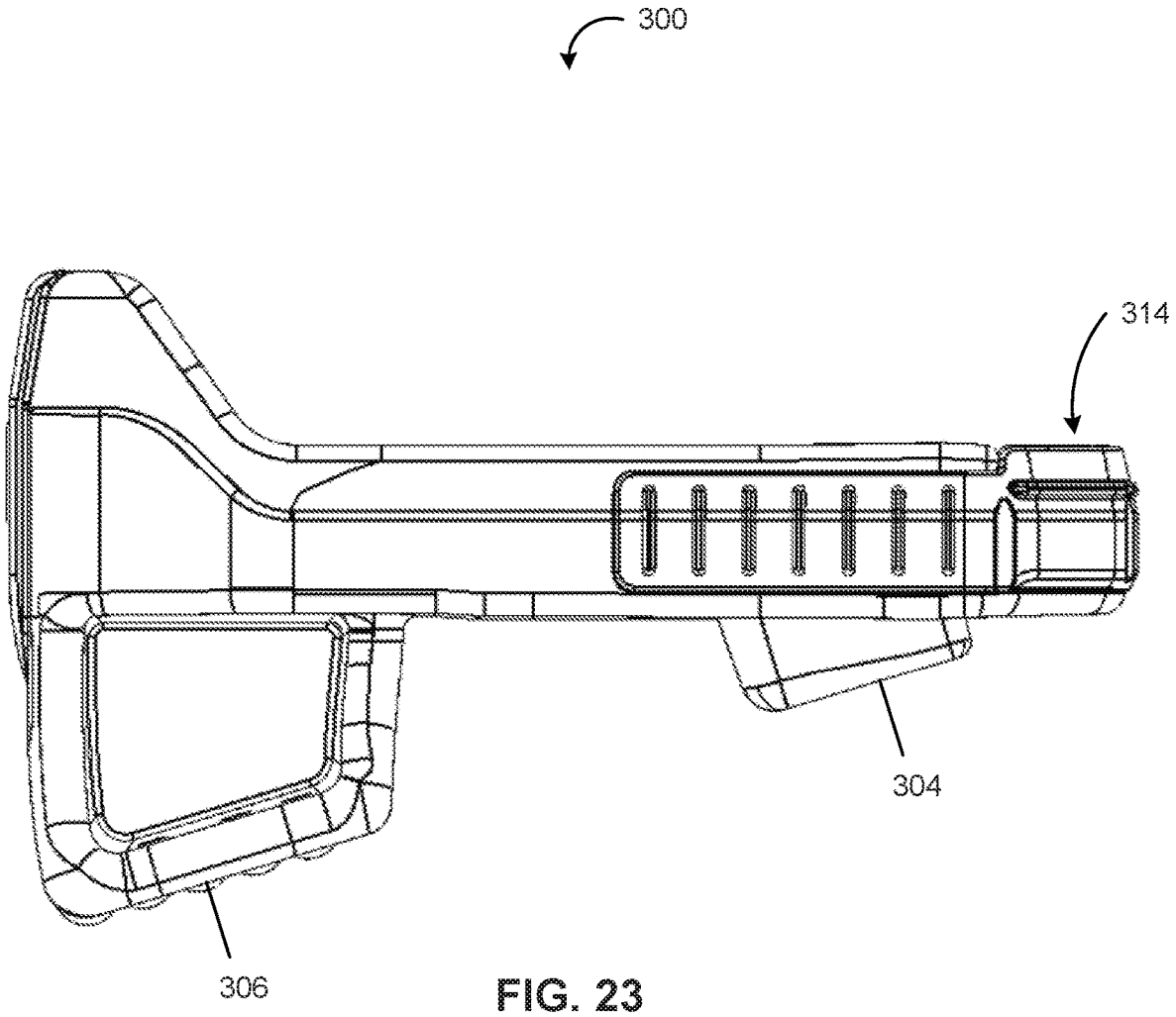
FIG. 23 depicts a side view of the shooting rest in accordance with one or more embodiments of the disclosure.

In some embodiments, as depicted in FIG. 22, the shooting rest 300 includes a body 302 configured to mount onto the bottom of a firearm magazine (not shown). The body 302 includes a top side 372, an opposed bottom side 370, a fore end 334, and an aft end 336. For example, the shooting rest 300 may slide onto the bottom of a firearm magazine to stabilize the firearm while the firearm is being discharged. In other instances, the shooting rest 300 may snap, fasten, or button onto the bottom of a firearm magazine. For example, the firearm magazine may include a lip 312 (i.e., a ridge protruding around the bottom of the magazine) that is configured to receive the shooting rest 300. The shooting rest 300 may securely attach to the firearm magazine via the lip and hold in place by friction and pressure. In other instances, the shooting rest 300 may grapple the magazine by another method, including strap, hook-and-loop, or some other interlocking mechanism. One benefit of the shooting rest 300 may include quick and efficient tool-less installation. In some instances, the shooting rest 300 comprises a glass fiber reinforced nylon body. In other instances, the shooting rest 300 may be composed of polyethylene terephthalate, polyethylene, polyvinyl chloride, polypropylene, polystyrene, polylactic acid, polycarbonate, acrylic, metal alloy, or some combination therein.

In some embodiments, the body 302 of the shooting rest 300 includes a set of legs configured to stabilize a discharging firearm. The set of legs includes at least one front leg 306 and a set of rear legs 304. Each set of legs may be located opposite to one another on the shooting rest 300. For example, the front leg(s) 306 are disposed on the aft end 336 of the body 302 of the shooting rest 300. Accordingly, the rear legs 304 are disposed on the fore end 334 of the shooting rest 300. In some instances, the front leg(s) 306 and rear legs 304 may be disposed on either the aft end 336 or fore end 334 of the shooting rest. The set of legs are configured to create a stabilizing and leveling mount for the firearm magazine. That is, since a firearm magazine bottom (i.e., side opposite to the magazine side that dispenses bullets) may not be parallel with the firearm barrel, the shooting rest legs may create a level surface with the firearm barrel. In other embodiments, the legs may be another shape, such as an arcuate bridge, pegs, or some other stabilizing structure.

The at least one front leg 306 may include a U-shaped wall, a diving wall, and a grip pad 318. The U-shaped wall may form the exterior of the front leg 306. For example, the U-shaped wall may extend from the bottom of the shooting rest 300. The U-shape may form by two perpendicular walls to the base of the shooting rest 300 and a bridge between the two perpendicular walls. Within the U-shaped wall is a supporting wall extending between the U-shaped perpendicular walls. In some instances, the front leg may be solid and not form a U-shaped wall. In other instances, the front leg may be hollow.

Figure 24:
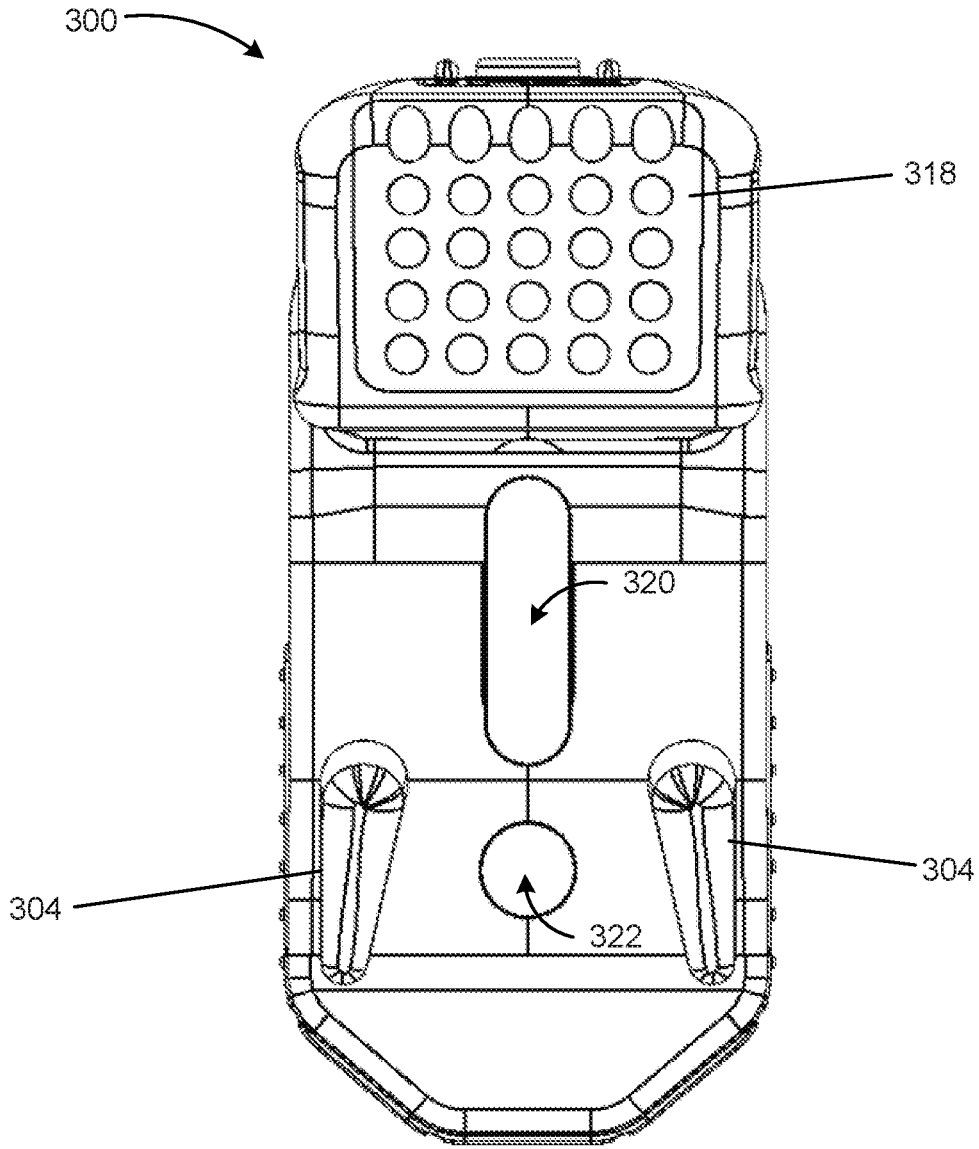
FIG. 24 depicts a bottom view of the shooting rest in accordance with one or more embodiments of the disclosure.

In some embodiments, as shown in FIGS. 22 and 24, the front leg includes a grip pad 318 configured to increase skid resistance for when the shooting rest 300 is set onto a surface and the firearm is discharged. The grip pad 318 may include a plurality of bumps along the surface of the grip pad 318. In other instances, the grip pad 318 may include a different resistant design, such as a flat surface, a series of ridges, or some other design. The grip pad 318 may be disposed on one place of the shooting rest 300 or may be disposed along several places on the shooting rest 300.

In some embodiments, as shown in FIG. 24, the shooting rest 300 includes a set of rear legs 304 configured to work in tandem with the at least one front leg 306 to provide stability to the firearm. For example, the set of rear legs 304 are disposed at the fore end 334 of the shooting rest 300. The set of rear legs 304 form a flat surface at one end, substantially flush with the grip pad 318 of the at least one front leg 306. As shown in FIG. 24, the set of rear legs 304 are two legs disposed on opposite sides of the shooting rest 300 to give a solid stance for the firearm set upon a solid surface. In some instances, the set of rear legs 304 includes two legs. In other instances, the shooting rest 300 may include more or less than two rear legs. In some instances, the set of rear legs 304 are teardrop shape. In other instances, the set of rear legs 304 may be rectangular, spherical, or some other shape therein.

Figure 25:
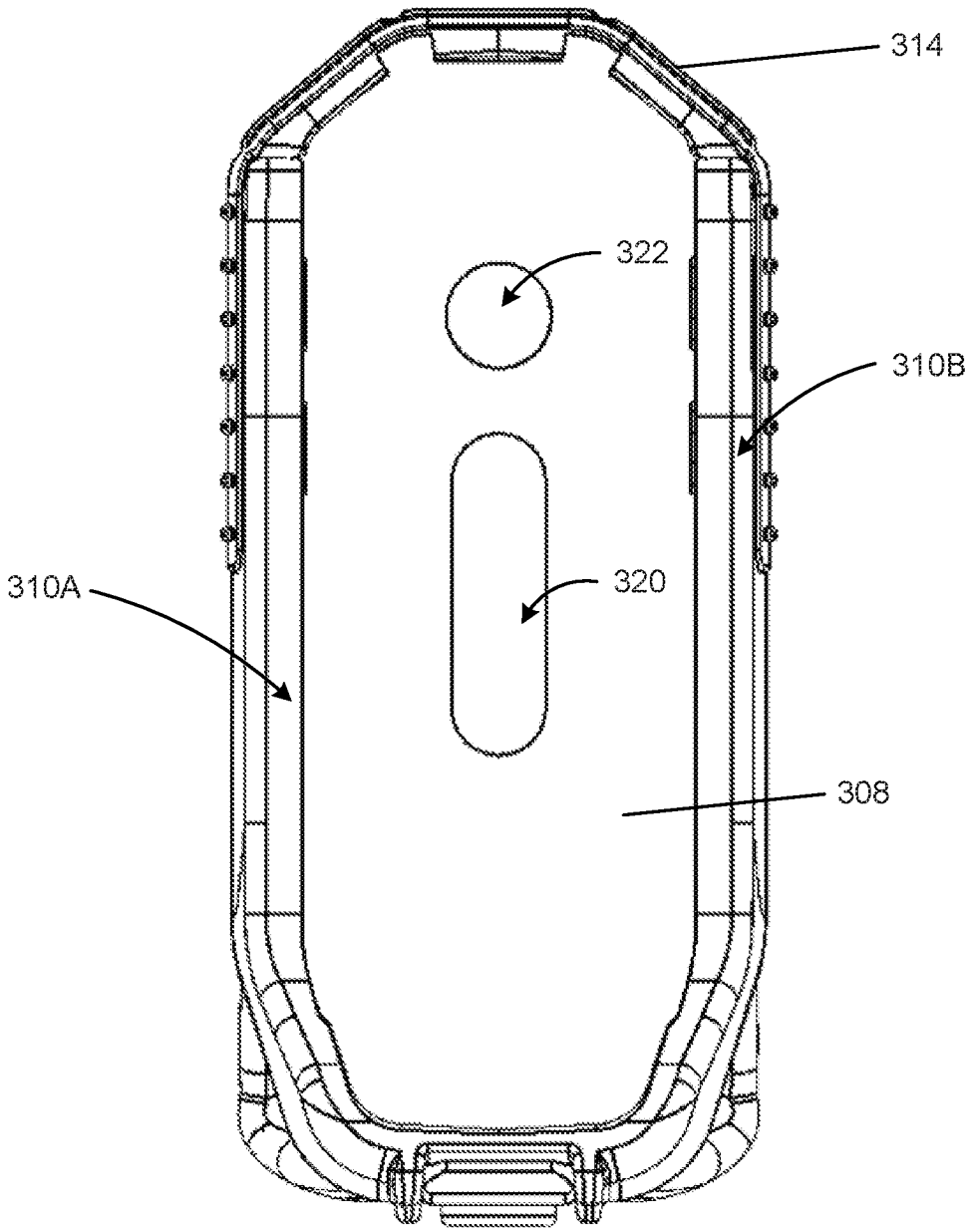
FIG. 25 depicts a top view of the shooting rest in accordance with one or more embodiments of the disclosure.

In some embodiments, as shown in FIGS. 22 and 25, the shooting rest 300 includes a set of walls 310A, 310B. The set of walls 310A, 310B are configured to wrap the base of a firearm magazine by grappling the lip (not shown) of the magazine by the ledge 312 disposed at the edge of the set of walls 310A, 310B opposite the shooting rest 300 floor 308. For example, the firearm magazine may slide between the set of walls 310A, 310B to secure the shooting rest 300. The set of walls 310A, 310B may form an elongated c-shape and coupled to a tension band 314, discussed later, to wrap the bottom of the firearm magazine. In some instances, the set of walls 310A, 310B extend perpendicular from the floor 308. In other instances, the set of walls 310A, 310B may extend at some other angle from the floor 308. In some instances, the set of walls 310A, 310B have a plurality of apertures (not shown) to secure elongated pegs 352 from the tension band 314. In other instances, the set of walls 310A, 310B may include a different means for securing the tension band 314 for the firearm magazine.

In some embodiments, as shown in FIG. 24, the floor 308 of the shooting rest 300 includes a plurality of floor apertures (i.e., 320, 322). The plurality of apertures may be configured to receive different sized and shaped protrusions from the bottom of the firearm magazine. For example, the first aperture 320 may be an elongated opening along the floor 308 of the shooting rest 300 and the second aperture 322 may be a circular opening. In some instances, the apertures may be different shapes to accommodate the firearm magazine. For instance, the apertures may be square, rectangular, triangular, or some other shape therein.

Figure 26:
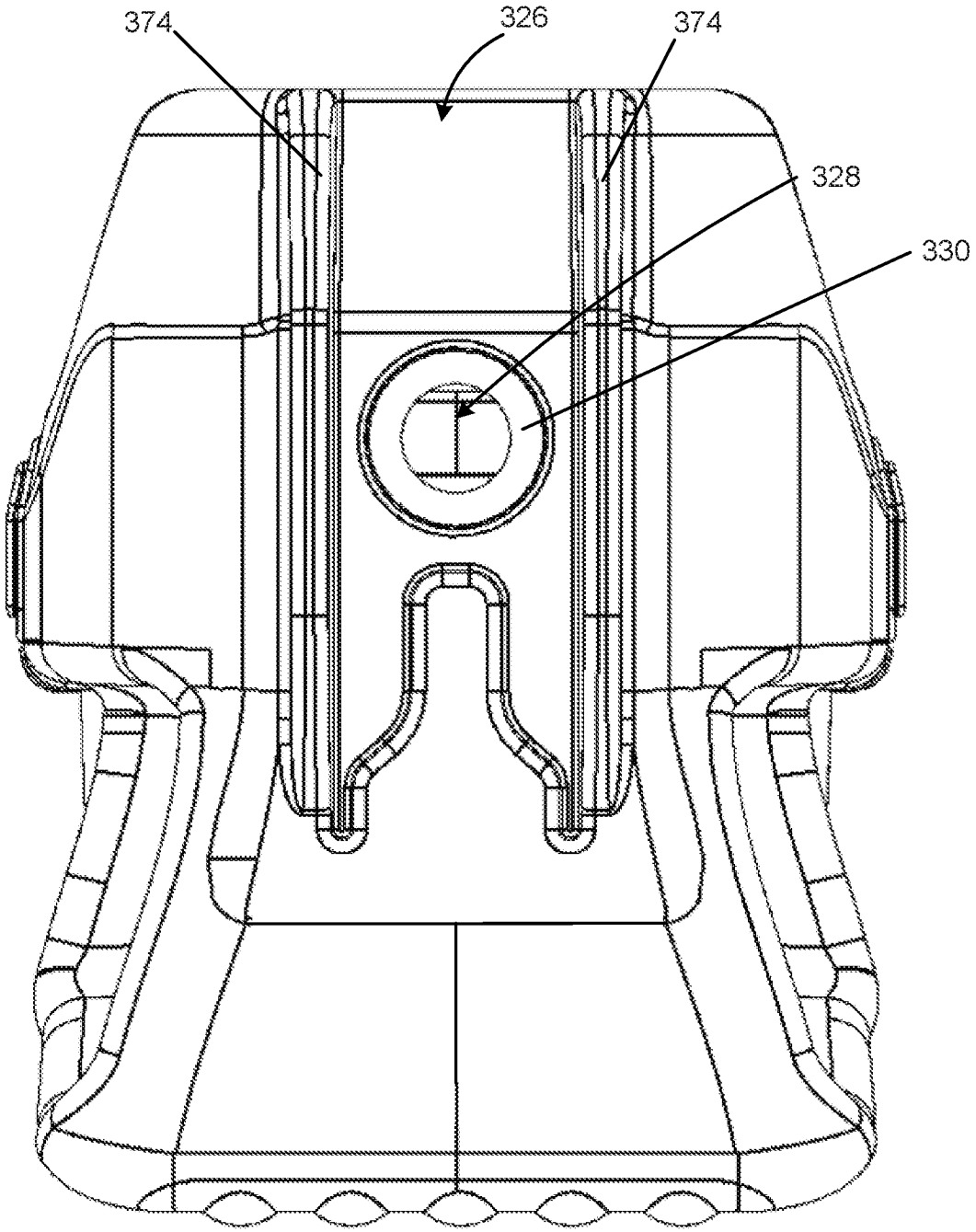
FIG. 26 depicts a front view of the shooting rest in accordance with one or more embodiments of the disclosure.

In some embodiments, as shown in FIG. 26, the shooting rest 300 includes a tool indention 326 configured to receive a removable tool. For example, the tool indention 326 may have two opposing ridges 374 configured to protect the removable tool from accidental damage or removal. For instance, many forces and obstacles may impact a firearm during battle, and a tool embedded on the exterior of a firearm may be subject to accidental detachment, thus a tool indention 326 may increase the likelihood of preventing accidental detachment. In some instances, the tool indention 326 may fit the shape of the removable tool. In some embodiments, as shown in FIG. 26, the tool indention 326 includes two side walls, an open end, and an oblong protrusion. In other instances, the tool indention 326 may be configured to suit another removable tool.

The tool indention 326 includes a tool engagement aperture 328 lined with an engagement lip 330. For example, the tool engagement aperture 328 may be configured to receive a protrusion or peg of the removable tool. The tool engagement aperture 328 is lined with an engagement lip 330 composed of a synthetic material (i.e., rubber, nylon, or some other plastic) configured to grapple the removable tool protrusion. For example, the tool protrusion (not shown) may be press-fit within the aperture. In some instances, the engagement lip 330 may secure the tool by some other means, including a fastener (i.e., screw, snap) or adhesive. The engagement lip 330 may be configured to resist any accidental movement of the tool's removal from the indention 326. The engagement lip 330 may be configured to give an external perpendicular force to the tool engagement aperture 328. In some instances, the tool engagement aperture 328 may be circular. In other instances, the tool engagement aperture 328 may be rectangular, square, triangular, or some other shape therein. The tool engagement aperture 328 and engagement lip 330 may have a plurality of different sizes.

The shooting rest 300 includes a tension band 314 configured to provide impact protection for the firearm magazine. As previously discussed, the tension band 314 may be connected to the apertures within the walls 310A, 310B of the shooting rest 300. In this manner, the tension band may be disposed within or outside the channels of the walls. In some instances, the tension band 314 may comprise a flat elastic band. The tension band 314 may be textured to enhance gripability and provide extra protection against magazine breakage. For example, the tension band 314 may include a number of ribs or the like. The tension band 314 may extend from one wall 310A to the opposite wall 310B around the fore end 334 of the shooting rest 300. The tension band 314 may be any suitable size, shape, or configuration.

Figure 27:
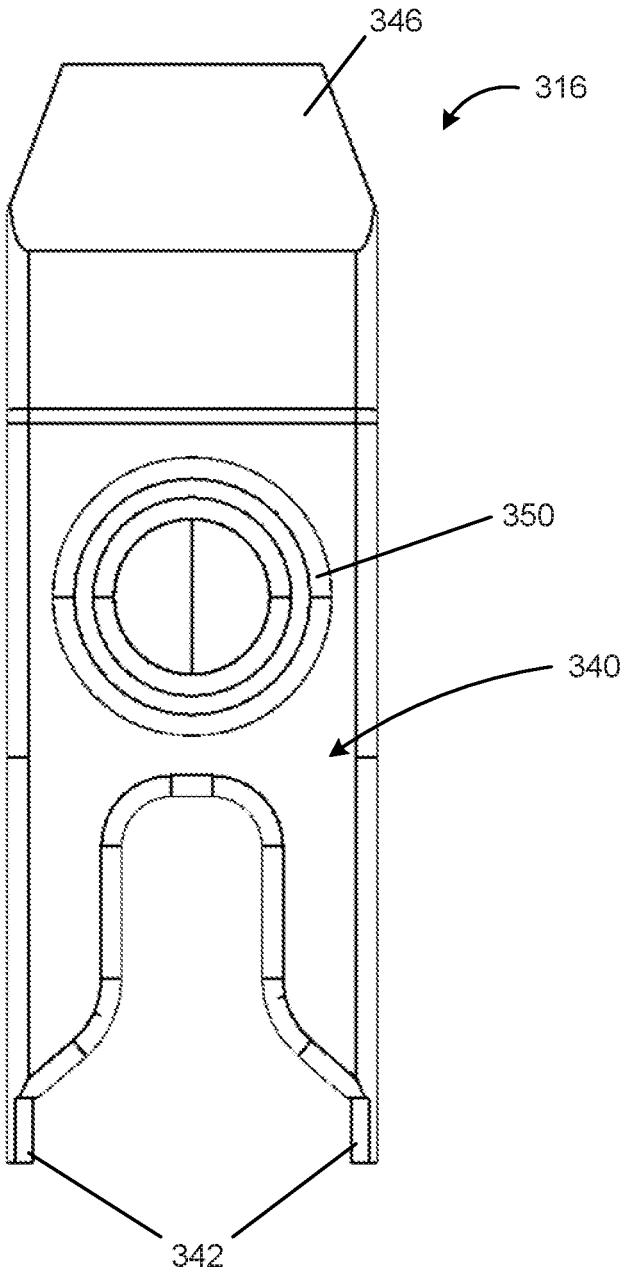
FIG. 27 depicts a front view of a removable tool in accordance with one or more embodiments of the disclosure.
Figure 28:
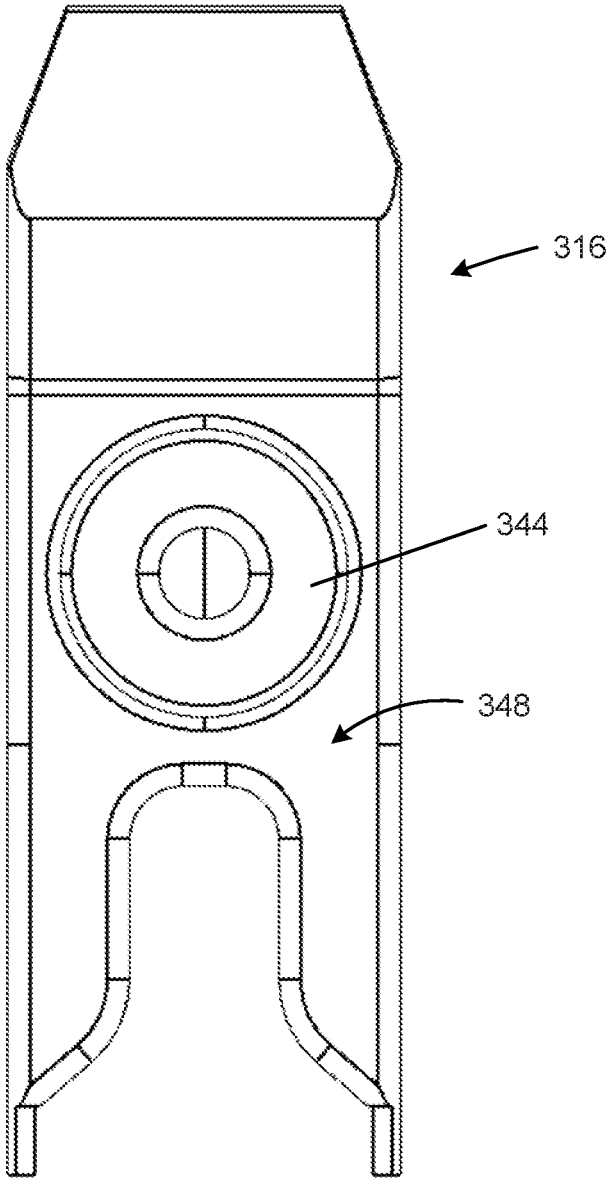
FIG. 28 depicts a rear view of the removable tool in accordance with one or more embodiments of the disclosure.
Figure 29:
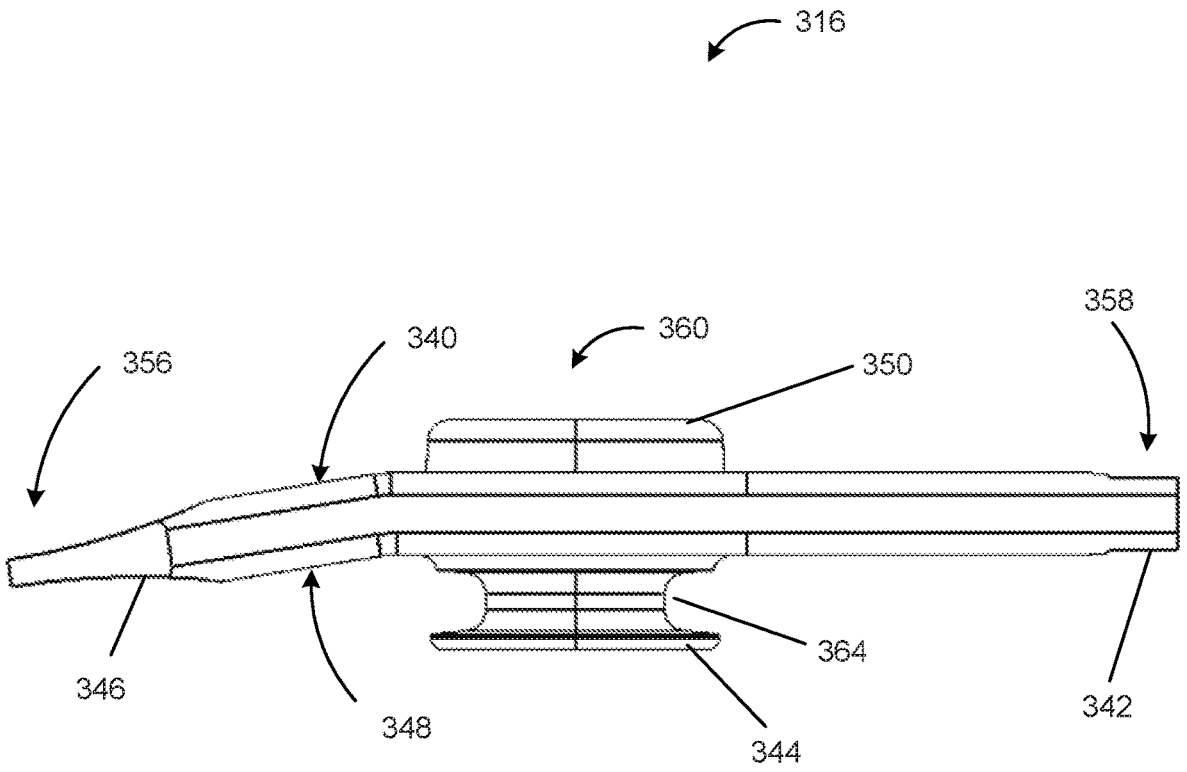
FIG. 29 depicts a side view of the removable tool in accordance with one or more embodiments of the disclosure.

In some embodiments, as shown in FIG. 22, within the tool indention rests a selectively removable tool 316. The removable tool, as seen in FIGS. 27-29, includes a front side 340, an opposing rear side 348, a first end 356, a second end 358, and a middle portion 360. In some instances, the selectively removable tool 316 may include a plurality of tools disposed on each side. For example, the removable tool 316 may include a screwdriver flat head 346 on one end of the removable tool and a spanner wrench 342 on the opposing side. In some embodiments, the removable tool 316 includes a protruding lip 350 configured to help a user pull the removable tool from the tool engagement aperture 328 and engagement lip 330. In some instances, the protruding lip 350 may be donut-shaped. The protruding lip 350 may pull a handle 344 engaged with an engagement lip 330. For example, the rear side 348 of the removable tool 316 includes a handle 344 disposed on the removable tool 316. The handle 344 may be circular and complementary to the tool engagement aperture 328. For example, the handle 344 may include a semi-circular channel 364 configured to engage the tool engagement aperture 328. The handle 344 may be press fit within the engagement aperture 328 and the engagement lip 330 may grip the handle 344. The removable tool 316 may have a variety of other means to secure onto the shooting rest 300, such as adhesive, fasteners, latches, storage container, or some other means.

The removable tool 316 may include a variety of different tooling, such as hex keys, punches, screwdrivers, wrenches, ruler, scope ring tool, level, or some other tool disposed on one end of the removable tool 316.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed:

1. A shooting rest, comprising:
- a body comprising:
  - a fore end, an aft end, and a floor, the floor comprising a top side and an opposed bottom side;
  - a set of walls extending from the top side of the floor; and
  - a set of legs extending from the opposed bottom side of the floor;
- a tension band coupled between the set of walls; and
- a selectively removable tool disposed on the body.

2. The shooting rest of claim 1, wherein the set of legs comprises a front leg and a set of rear legs.

3. The shooting rest of claim 2, wherein the front leg comprises a grip pad.

4. The shooting rest of claim 1, wherein the set of walls comprises a ledge configured to grapple a firearm magazine.

5. The shooting rest of claim 1, wherein the floor comprises a plurality of floor apertures.

6. The shooting rest of claim 1, wherein the set of walls comprises a plurality of wall apertures configured to receive one or more elongated pegs of the tension band.

7. The shooting rest of claim 1, wherein the body comprises:
- a tool indention disposed on the body;
- a tool engagement aperture configured to secure the selectively removable tool; and
- an engagement lip disposed within the tool indention, wherein the engagement lip is configured to secure the tool.

8. The shooting rest of claim 7, wherein the selectively removable tool comprises:
- a front side, an opposing rear side, a first end, a second end, and a middle portion;
- a protruding lip extending from the front side; and
- a handle extending from the opposing rear side, wherein the handle is configured to engage the engagement lip.

9. The shooting rest of claim 8, wherein the selectively removable tool comprises:
- a spanner wrench disposed on the second end; and
- a screwdriver tip disposed on the first end.

10. The shooting rest of claim 8, wherein the protruding lip is circular.

11. The shooting rest of claim 8, wherein the handle comprises a channel configured to engage the tool engagement aperture, wherein the engagement lip secures the handle.

12. The shooting rest of claim 11, wherein the channel is semi-circular.

13. A shooting rest, comprising:
- a body comprising:
  - a fore end, an aft end, and a floor, the floor comprising a top side and an opposed bottom side;
  - a tool engagement aperture disposed on the aft end of the body;
  - a set of walls extending from the top side of the floor; and
  - a set of legs extending from the opposed bottom side of the floor;
- a tension band coupled between the set of walls; and
- a selectively removable tool disposed on the body, the selectively removable tool comprising a handle configured to engage the tool engagement aperture.

14. The shooting rest of claim 13, wherein the selectively removable tool comprises:
- a front side, an opposing rear side, a first end, a second end, and a middle portion;
- a spanner wrench disposed on the second end; and
- a screwdriver tip disposed on the first end.

15. The shooting rest of claim 13, wherein the set of legs comprises a front leg and a set of rear legs.

16. The shooting rest of claim 15, wherein the front leg comprises a grip pad.

17. The shooting rest of claim 13, wherein the set of walls comprises a ledge configured to grapple a firearm magazine.

18. The shooting rest of claim 13, wherein the floor comprises a plurality of floor apertures.

19. The shooting rest of claim 13, wherein the set of walls comprises a plurality of wall apertures configured to receive one or more elongated pegs of the tension band.

20. A shooting rest, comprising:
- a body comprising:
  - a fore end, an aft end, and a floor, the floor comprising a top side and an opposed bottom side;
  - a tool indention disposed on the body;
  - a set of walls extending from the top side of the floor; and
  - a set of legs extending from the opposed bottom side of the floor;
- a tension band coupled between the set of walls;

a selectively removable tool configured to engage the tool indention, wherein the tool indention comprises a tool engagement aperture configured to secure the selectively removable tool.

* * * * *